United States Patent [19]

Jorgensen

[11] 4,223,936

[45] Sep. 23, 1980

[54] CONVERTIBLE HOUSEHOLD UTENSIL ASSEMBLY

[75] Inventor: Carsten Jorgensen, Koge, Denmark

[73] Assignee: Copco, Inc., New York, N.Y.

[21] Appl. No.: 15,583

[22] Filed: Feb. 27, 1979

[51] Int. Cl.[3] ..... A47G 21/02

[52] U.S. Cl. ..... 294/16; 294/99 R

[58] Field of Search ..... 294/2, 3, 7, 8, 8.5, 294/11, 16, 33, 99 R, 99 S; D7/105; 30/147–150; 81/43

[56] References Cited

U.S. PATENT DOCUMENTS

| | | | |
|---|---|---|---|
| 2,024,849 | 12/1935 | Eliopoulos | 294/99 R |
| 2,292,889 | 8/1942 | McKee | 294/7 |

FOREIGN PATENT DOCUMENTS

| | | | |
|---|---|---|---|
| 811925 | 4/1937 | France | 294/99 S |
| 9580 of 1909 | | United Kingdom | 294/99 R |
| 454171 | 9/1936 | United Kingdom | 294/99 R |

*Primary Examiner*—Johnny D. Cherry
*Attorney, Agent, or Firm*—Michael Ebert

[57] ABSTRACT

A dual-purpose, convertible household utensil assembly which in one mode operates as two separate implements for mixing a salad, and in the other mode acts as tongs in which the two implements are hinged together and function as a grasping device for serving portions of the mixed salad. The assembly is constituted by two implements such as a fork and a spatula, both having like shanks whose end sections define channel-like sockets, and a removable U-shaped yoke having a pair of legs which are receivable in these sockets to join the implements together and a resilient cross-piece which interconnects the legs to form a hinge.

4 Claims, 4 Drawing Figures

Fig. 1.
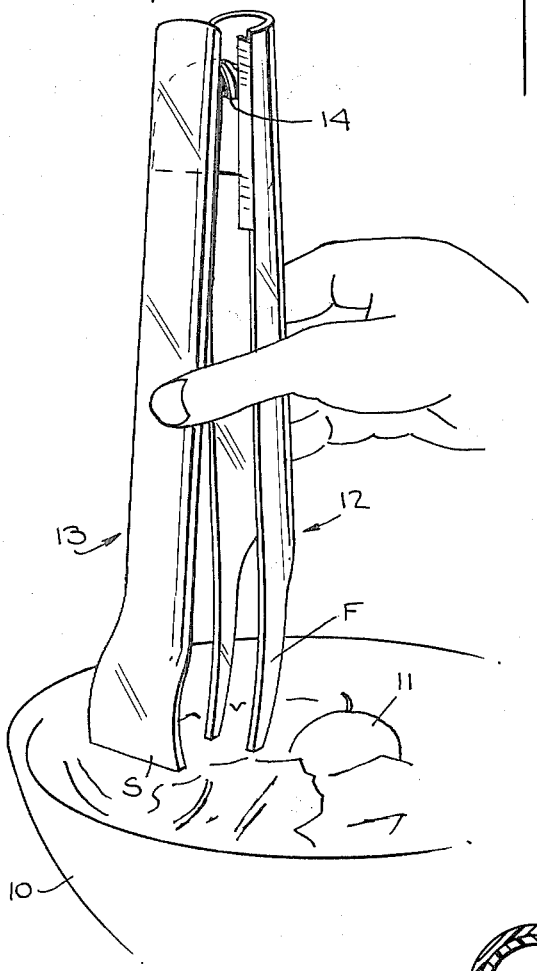
Fig. 4.
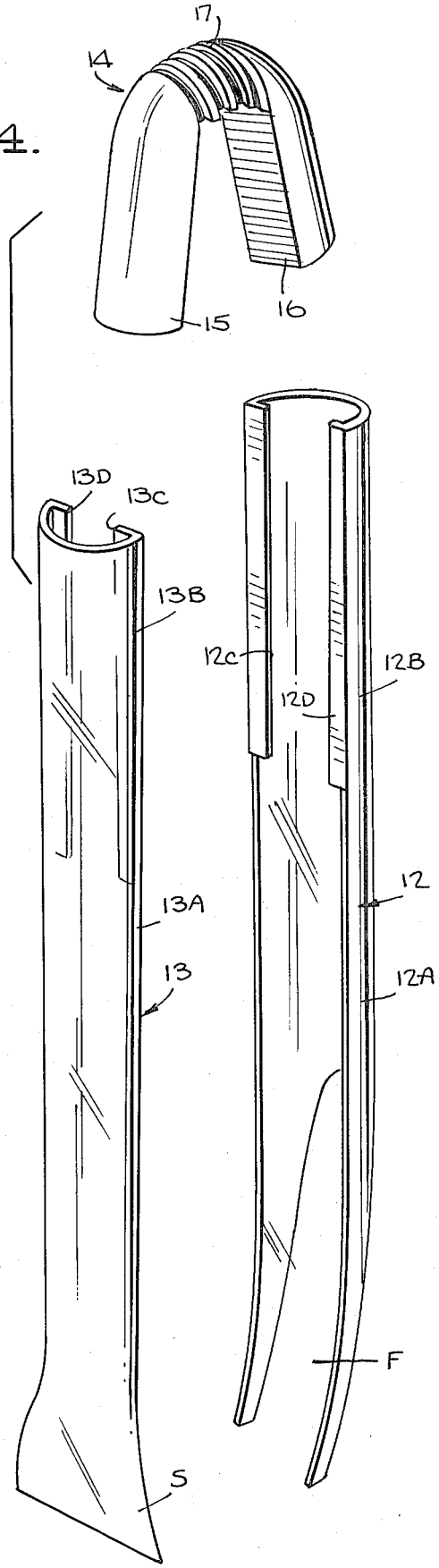
Fig. 2.
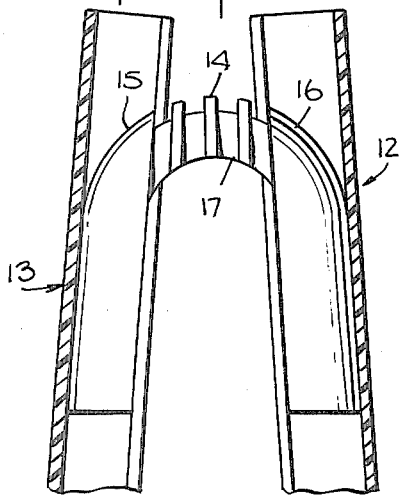
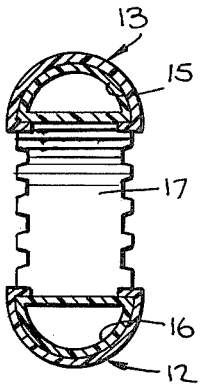
Fig. 3.

CONVERTIBLE HOUSEHOLD UTENSIL ASSEMBLY

BACKGROUND OF INVENTION

This invention relates generally to household utensils, and more particularly to a dual-purpose, convertible utensil assembly which in one mode operates as two separate implements for mixing a salad or for other household purposes, and in the other mode functions as a tongs in which the two implements are hinged together to serve as a grasping device.

In preparing a vegetable salad, one cuts lettuce or endive and other vegatables such as tomatoes, cucumbers and radishes into small pieces, the cut pieces being placed in a mixing bowl. After sprinkling the cut pieces with a salad dressing, such as oil and vinegar, the pieces are then intermixed to spread the dressing and to disperse the pieces throughout the bowl. The implements for this purpose are usually a fork and spoon or spatula, the fork being held in one hand and the spatula in the other, so that portions of the sald can be raised from the bowl and then dropped therein to effect a mixing action.

When a mixed salad is properly prepared in this fashion, it is served by transferring portions of the salad to salad plates. The most efficient tool for effecting this transfer is a tongs composed of a pair of implements hinged together at one end.

In many households and even restaurants, tongs are not available, in which case the salad server usually holds the handles of both a fork and spoon in one hand in the manner of chop sticks, and then manipulates these utensils so that they cooperate as a tongs. But an improvised tongs of this type is relatively difficult to manipulate and requires a fair degree of skill and dexterity.

SUMMARY OF INVENTION

In view of the foregoing, the main object of this invention is to provide a dual purpose, convertible utensil assembly which is one mode operates as two separate implements and in the other mode as a tongs.

More particularly, the object of the invention is to provide an assembly of the above type in which the two implements take the form of a fork and spatula which have many conventional uses, such as utensils for mixing a salad, the same implements, when interhinged, functioning as a tongs.

Also an object of the invention is to provide a convertible utensil assembly fabricated entirely of synthetic plactic material which can be manufactured at low cost. A significant feature of this assembly is that it may be assembled or dismantled without difficulty, and easily and thoroughly cleaned.

Briefly stated, these objects are attained by two implements such as a fork and spatula, both having like shanks whose end sections are shaped to define channel-like sockets. The assembly is completed by a U-shaped yoke having a pair of legs which are receivable in the sockets of the implements to join the implements together, and a resilient cross-piece which interconnects the legs to form a hinge, making it possible to press the implements together between the thumb and fingers of one hand in order to grasp a portion of a mixed salad or other food ingredients.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a dual-purpose convertible utensil assembly in accordance with the invention shown operating in a serving tongs mode to grasp a portion of mixed salad;

FIG. 2 is a longitudinal section taken through the assembly in the tongs mode;

FIG. 3 is a transverse section taken through the assembly; and

FIG. 4 shows the yoke removed from the implements to render the implements separately usable in a free mode.

DESCRIPTION OF INVENTION

Referring now to FIG. 1, there is shown a salad bowl 10 containing a mixed salad 11 which is ready to be served, such service being performed by a dual-purpose convertible utensil assembly in accordance with the invention functioning in a tongs mode.

The assembly is constituted by a two-tined fork F whose structure is generally designated by numeral 12, a spatula S whose structure is generally designated by numeral 13, and a U-shaped yoke 14, all of which components are fabricated of a synthetic, sterilizable plastic material of high strength, such as polyvinyl chloride or polyethylene. The implements are preferably formed of a transparent plastic material, so that their state of cleanliness is readily observable. Since the assembly is readily dismantled, one may thoroughly clean all of its components without difficulty.

Fork 12 includes a shank 12A having a trough-like configuration, the edges of the upper end section 12B of the shank being provided with inwardly-directed flanges 12C and 12D, thereby defining a hollow, semi-cylindrical socket. Spatula 13 has a like shank 13A whose upper end section 13B has its edges provided with inwardly-directed flanges 13C and 13D to define a hollow, semi-cylindrical socket.

Yoke 14 is constituted by a pair of hollow legs 15 and 16 having a semi-cylindrical cross section which substantially matches the cross-sectional dimension of the spatula and fork sockets, so that the legs may be inserted and frictionally held therein. Because of the semi-cylindrical form of the sockets, with the base of this form being interrupted, the sockets are dilatable, in that the shanks are fabricated of resilient material.

Hence the sockets are somewhat yieldable to admit and then clamp onto the legs. The upper end of legs 15 and 16 are bridged by an arched cross piece 17 of synthetic plastic material, the arch being ribbed to reduce its thickness and to impart spring-like characteristics thereto so that it can function as a resilient hinge.

Cross piece 14, in the tongs mode of the assembly, as shown in FIG. 1, acts to interhinge implements 12 and 13, legs 15 and 16 of the cross piece being inserted in the end section sockets 12B and 13B of shanks 12A and 13A. When operating in this mode, the user grips the tongs between the thumb and fingers of one hand, a portion of the salad 11 in the bowl 10 being grasped between fork F and spatula S when the hinged implements are pressed together. In this way, the combined implements function as a tongs which can be used for any household purpose calling for a food-grasping device.

In the free mode, the cross piece is removed from the implement sockets, and one is now able to use the fork and spatula to mix a salad or to carry out any other household activity for which these utensils are suitable.

While there has been shown and described a preferred embodiment of a convertible household utensil assembly in accordance with the invention, it will be appreciated that many changes and modifications may be made therein without, however, departing from the essential spirit thereof.

I claim:

1. A dual purpose, convertible household utensil assembly comprising:

A first and second food handling implements formed of transparent synthetic plastic material which is resilient, each having a shank terminating in a hollow socket section having a semi-cylindrical cross-sectional formation provided with inwardly directed flanges on the inner side of the shank, thereby providing a pair of dilatable sockets; and B a removable yoke formed of synthetic plastic material for interconnecting said implements, said yoke being constituted by a pair of legs having a corresponding cross-sectional formation insertable in said dilatable sockets and clamped thereby and a resilient ribbed cross-piece bridging said legs to define a hinge whereby when the yoke is joined to said implements, the resultant assembly functions as a tongs, the cross-piece having a thickness which is slightly less than the space between the flanges whereby the yoke is insertable to a depth which places the yoke below the ends of the socket sections, and when said yoke is removed therefrom, the implements are separately usable.

2. An assembly as set forth in claim 1, wherein said first implement is a fork and the second implement is a spatula.

3. An assembly as set forth in claim 1, wherein said first and second implements are forks.

4. An assembly as set forth in claim 1, wherein said first and second implements are spatulas.

* * * * *